US008016128B2

(12) United States Patent
Valiulis et al.

(10) Patent No.: US 8,016,128 B2
(45) Date of Patent: Sep. 13, 2011

(54) WHEELED PUSHER SYSTEM

(75) Inventors: Stanley C. Valiulis, Rockford, IL (US); Patrick J. Barkdoll, Pecatonica, IL (US)

(73) Assignee: Southern Imperial, Inc., Rockford, IL (US)

( * ) Notice: Subject to any disclaimer, the term of this patent is extended or adjusted under 35 U.S.C. 154(b) by 569 days.

(21) Appl. No.: 12/174,157

(22) Filed: Jul. 16, 2008

(65) Prior Publication Data

US 2010/0012602 A1 Jan. 21, 2010

(51) Int. Cl.
*A47F 7/00* (2006.01)

(52) U.S. Cl. ..... 211/59.3

(58) Field of Classification Search ..... 211/59.2, 211/59.3, 184, 183; 312/61, 71
See application file for complete search history.

(56) References Cited

U.S. PATENT DOCUMENTS

| | | | | |
|---|---|---|---|---|
| 4,238,022 | A * | 12/1980 | Williams | 193/32 |
| 4,899,668 | A | 2/1990 | Valiulis | |
| 5,161,704 | A | 11/1992 | Valiulis | |
| 5,971,173 | A | 10/1999 | Valiulis et al. | |
| 6,142,317 | A * | 11/2000 | Merl | 211/59.3 |
| 6,253,954 | B1 * | 7/2001 | Yasaka | 221/93 |
| 6,401,942 | B1 * | 6/2002 | Eckert | 211/59.3 |
| 6,464,089 | B1 * | 10/2002 | Rankin, VI | 211/59.3 |
| D472,331 | S | 3/2003 | Zadak | |
| 6,533,131 | B2 * | 3/2003 | Bada | 211/59.2 |
| D480,231 | S | 10/2003 | Valiulis et al. | |
| 6,820,754 | B2 * | 11/2004 | Ondrasik | 211/59.3 |
| 6,889,854 | B2 | 5/2005 | Burke | |
| 6,964,235 | B2 | 11/2005 | Hardy | |
| 7,497,342 | B2 * | 3/2009 | Hardy | 211/59.3 |
| 7,896,171 | B2 * | 3/2011 | Battaglia | 211/59.2 |
| 7,905,364 | B2 * | 3/2011 | Pail | 211/59.3 |
| 2002/0108916 | A1 * | 8/2002 | Nickerson | 211/59.3 |
| 2002/0148794 | A1 * | 10/2002 | Marihugh | 211/59.3 |
| 2003/0141265 | A1 * | 7/2003 | Jo et al. | 211/59.3 |
| 2006/0049122 | A1 * | 3/2006 | Mueller et al. | 211/59.3 |
| 2006/0096938 | A1 * | 5/2006 | Kanou | 211/184 |
| 2006/0163180 | A1 * | 7/2006 | Rankin et al. | 211/59.3 |
| 2006/0201897 | A1 * | 9/2006 | Mueller et al. | 211/59.3 |
| 2006/0237381 | A1 * | 10/2006 | Lockwood et al. | 211/59.3 |

(Continued)

FOREIGN PATENT DOCUMENTS

DE 202005010088 U 9/2005

(Continued)

OTHER PUBLICATIONS

POS Tuning—für mehr Erfolg am Point of Sale: PO T-Product Pusher; http://www.postuning.de/69.0.html?&L=2, website, date last visited Mar. 29, 2006, 1 page.

POS Tuning—für mehr Erfolg am Point of Sale: The POS T-Systemtray; http://www.postuning.de/68.0.html?L=2 website, date last visited Mar. 29, 2006, 1 page.

*Primary Examiner* — Jennifer E. Novosad
(74) *Attorney, Agent, or Firm* — Reinhart Boerner Van Deuren P.C.

(57) ABSTRACT

A wheeled pusher system is provided. Situated upon a retail merchandise shelf is pusher assembly interposed between a pair of partition walls for facing retail merchandise. Various improvements are disclosed including the incorporation of wheels with the pusher assembly to reduce jamming and drag as the pusher assembly faces retail merchandise, a single and separate mounting rail to facilitate easier assembly of the system, and a ramped product support surface integral to the partitions to more effectively face the retail merchandise.

19 Claims, 7 Drawing Sheets

U.S. PATENT DOCUMENTS

2007/0029270 A1* 2/2007 Hawkinson ..... 211/59.3
2007/0090068 A1* 4/2007 Hardy ..... 211/59.3
2007/0175844 A1* 8/2007 Schneider ..... 211/184
2007/0267364 A1 11/2007 Barkdoll
2010/0078398 A1* 4/2010 Hardy ..... 211/59.3
2010/0258513 A1* 10/2010 Meyer et al. ..... 211/59.3

FOREIGN PATENT DOCUMENTS

EP 1 541 064 A1 6/2005
WO WO 2004/083051 A2 9/2004

* cited by examiner

WHEELED PUSHER SYSTEM

FIELD OF THE INVENTION

This invention generally relates to pusher systems and, in particular, to a pusher system employed to front face retail merchandise on a retail shelf.

BACKGROUND OF THE INVENTION

To ensure that retail merchandise stocked upon a shelf is suitably presented to a potential customer, the merchandise may be "front faced" using what is generally known in the art as a pusher system. The process of facing often involves sliding the merchandise, which is typically situated upon a retail shelf in rows, toward a front edge of the shelf. Examples of merchandise that is typically faced include beverage containers and digital video discs.

To face the merchandise, the merchandise is loaded into a channel defined by two or more partitions. The partitions assist in maintaining the merchandise in a linear row within the channel. A pusher assembly, biases the row of merchandise forward until the front most unit of merchandise is in engageable contact with a stop located at the front edge of the retail shelf. Placing merchandise at the edge of a retail shelf is generally recommended for effective product placement, as it provides a potential customer with an easily identifiable product that is presented in a neat and aesthetically pleasing orientation. The partitions and pusher assembly work in combination to achieve this result. An exemplary design of such a pusher system is shown in U.S. Patent Application Publication US 2007/0267364 assigned to the present assignee. The present invention relates to improvements over that design.

BRIEF SUMMARY OF THE INVENTION

The present invention has several aspects, each of which is patentable in its own right.

In a first aspect, an embodiment of the present invention provides a retail pusher and divider system that incorporates a wheeled pusher assembly for facing retail merchandise. A retail pusher and divider system according to this aspect comprises a front stop and a pair of partitions adapted to provide in combination with the front stop a retail merchandise channel. A pusher assembly is interposed within the retail merchandise channel and movable toward and away from the front stop. The pusher assembly includes at least one wheel operably connected to the pusher assembly allowing for wheeled translation of the pusher assembly toward and away from the front stop. By utilizing wheels, the pusher assembly is less subject to jamming or binding during movement.

In accordance with this first aspect, an embodiment of the invention may also include an axle that is interlocked with the body of the pusher assembly. Once interlocked, the axle is free to rotate about its central axis. At least one wheel is connected to the axle such that rotation of the axle results in rotation of the wheel. In this configuration, the pusher assembly may ride directly on the retail merchandise shelf. Also in accordance with this first aspect, an embodiment of the invention may include a rail member that defines a channel. In this configuration, the pusher assembly resides within the channel, and the wheels of the pusher assembly are in contact with the channel bottom.

In a second aspect, an embodiment of the present invention provides a retail pusher and divider system having a front mounting rail formed separately from the front stop. A retail pusher and divider system according to this aspect comprises a front stop that has a base portion and an upright portion. A front mounting rail is formed separately and mounted to the base portion of the front stop. A pair of partitions are mounted to the front mounting rail and define a retail merchandise channel between the partitions and the front stop. By forming the front mounting rail separately from the front stop, the rail may be made of a material having a greater elasticity than the front stop thereby facilitating easier connection of the partitions to the front mounting rail, while at the same time maintaining a more rigid front stop.

In accordance with the aspects herein, an embodiment of the invention may further include a pusher assembly commonly mounted with the partitions to the front mounting rail. The pusher assembly is biased toward the front stop under the action of a spring. The spring is contained within the body of the pusher assembly, and biases the pusher assembly forward once the pusher assembly is retracted away from the front stop and front mounting rail. The invention may also further include a rear mounting rail that is connected to the partitions opposite the end of the partitions mounted to the front mounting rail.

In a third aspect, an embodiment of the present invention provides an improved design for mounting a pair of partitions and a pusher assembly proximate to a front stop using a single mounting rail. A retail pusher and divider system according to this aspect comprises a front stop having an upright and a base portion and a front mounting rail that is integral with the front stop. At least two partitions are mounted to the front mounting rail via a single partition mounting clip located at a front end of the partitions. The partitions may be laterally adjusted along the length of the rail in order to accommodate differing sizes of retail merchandise. At least one pusher assembly is also mounted to the front mounting rail via a single pusher mounting clip. The pusher assembly is biased toward the front stop under the action of a spring. The spring is contained within the body of the pusher assembly, and biases the pusher assembly forward once the pusher assembly is retracted away from the front stop and front mounting rail. A single mounting rail provides stability according to the embodiments herein and reduces the amount of assembly steps needed to adjust the spacing of the partitions and the location of the pusher assembly.

In accordance with the aspects herein, a further subsidiary feature may include a means for interlocking the partition and pusher mounting clips to the front rail, thus preventing lateral movement of the partitions and pusher assembly along the axis of the rail once interlocked. By providing a means for interlocking, the retail pusher and divider system prevents lateral shifting of the partitions due to the tendency of the retail merchandise within the channel to attempt to shift out of its linear orientation while being pushed forward by the pusher assembly. Also, by providing a means for interlocking, the retail pusher and divider system may be preassembled prior to shipment to a customer.

In a another aspect, an embodiment of the invention provides a ramping feature. In particular, a retail pusher and divider system according to this aspect ramps retail merchandise upward and toward a front stop, allowing the front most unit of retail merchandise to be situated against the front stop while not being impeded by a front mounting rail. A retail pusher and divider system according to this aspect includes a front stop that has an upright portion and a base portion, a front mounting rail that is integral with the front stop, and at least two partitions mounted to the front mounting rail, wherein each partition has a first ramp proximate to the front mounting rail that in part defines a first product support surface which is generally perpendicular to the partitions and proximate to the front mounting rail. The first product support surface is elevated above the front mounting rail such that retail merchandise may be displayed above the front mounting rail and flush with the front stop. Therefore the retail merchandise channel may have a selectable width by virtue of the front mounting rail, and the retail merchandise may be maintained above the front mounting rail and flush with the front stop by virtue of the ramped product support surface.

In accordance with the aspects herein, an embodiment of the invention may also include a rear mounting rail that is in opposed spaced relation to the front mounting rail, wherein a second end of the partitions have a second ramp proximate to the rear mounting rail and mounted thereto. The second ramp defines in part the product support surface that is elevated toward and above the rear mounting rail such that retail merchandise may be loaded upon the second product support surface unimpeded by the rear mounting rail. The first and second ramp sections may sandwich a base section therebetween, each ramped section extending outwardly and upwardly away from the base section. The at least two partitions may include an upright partition wall that extends upwardly from and integral with the base and ramped sections. Also in accordance with this final aspect, an embodiment of the invention may include a pusher assembly. The pusher assembly is biased toward the front stop under the action of a spring. The spring is contained within a pusher body, and biases the pusher assembly forward once the pusher assembly is retracted away from the front stop and front mounting rail.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
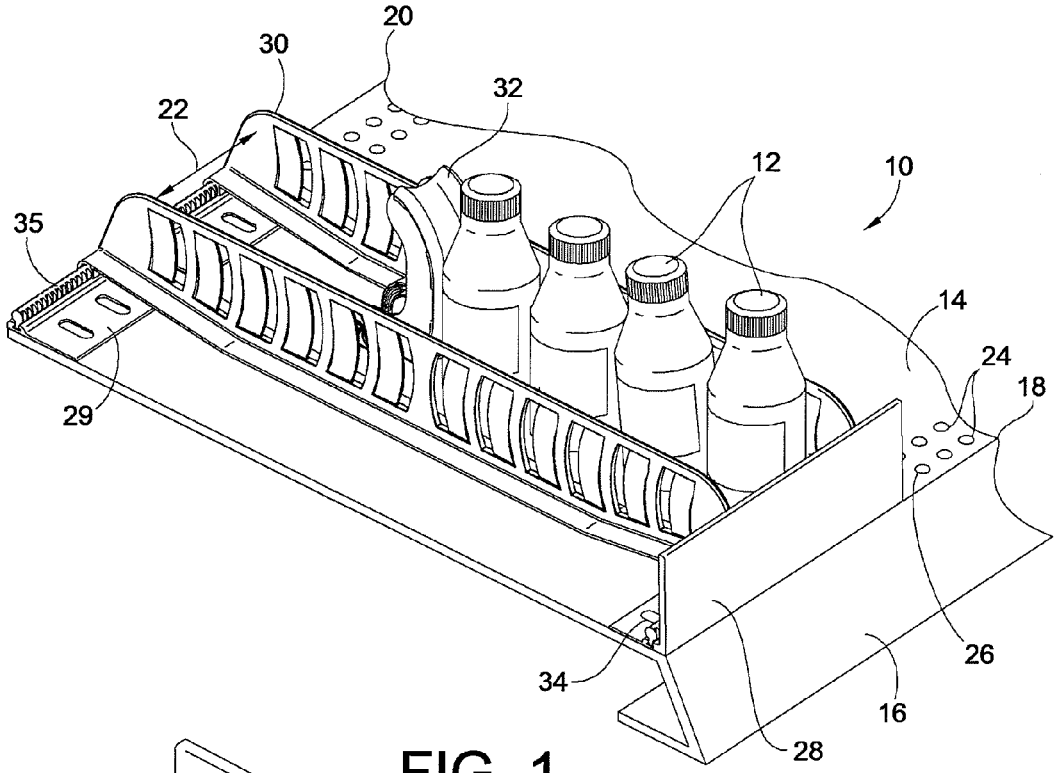
FIG. 1 is a perspective view of an exemplary embodiment of a retail pusher and divider system in accordance with the teachings of the present invention.

Referring to FIG. 1, a retail pusher and divider system 10 for facing retail merchandise 12 forward is illustrated. In general, the retail pusher and divider system 10 is seated upon a top surface 14 of a retail shelf 16. The retail pusher and divider system 10 extends between front and rear edges 18, 20 of the shelf 16. As well known in the art, the shelf 16 often includes rows 24 of apertures 26 formed through a top surface 14 of the shelf and extending generally parallel to the front and rear edges 18, 20.

The retail pusher and divider system 10 comprises one or more front stops 28, two or more partitions 30, one or more pusher assemblies 32, and a front mounting rail 34. In the illustrated embodiment, there is also shown a rear base member 29, and a rear mounting rail 35. For the sake of simplicity, the description will be drawn to a relatively simple embodiment having two partitions 30, one front stop 28, one front mounting rail 34, one rear base member 29, one rear mounting rail 35 and a single pusher assembly 32. However, it will be understood that retail merchandise channels 22 of the same or different widths can be created by utilizing three or more partitions in combination with the front stop 28 and with one or more pushers 32 installed into each retail merchandise channel 22 and connected to the front mounting rail 34 to face the retail merchandise 12.

Figure 2:
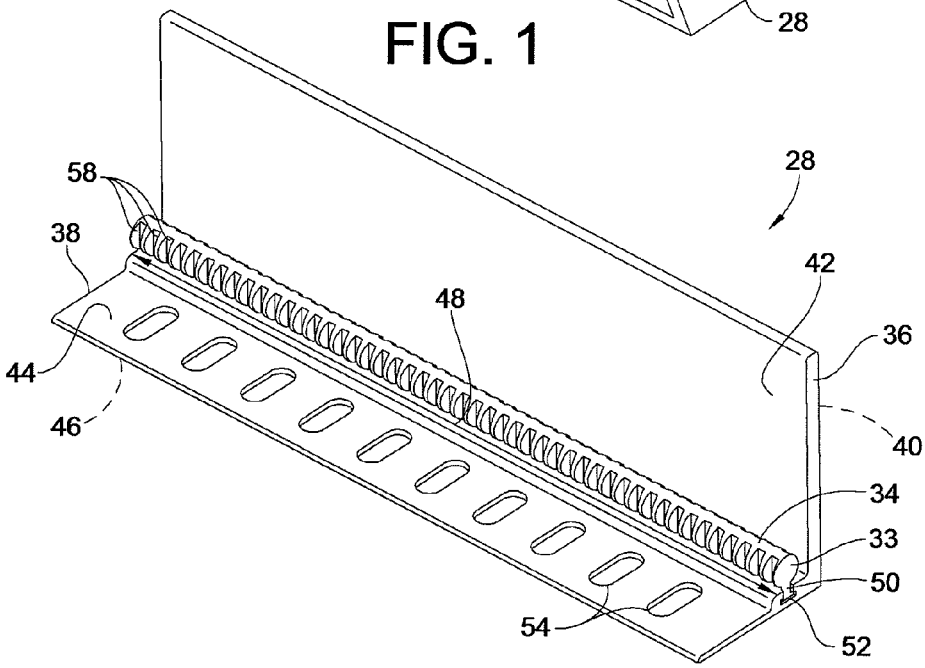
FIG. 2 is a top and rear perspective view of the front stop and the front mounting rail of the retail pusher and divider system of FIG. 1

Turning now to FIG. 2, the front stop 28 is generally the structure that stops the movement of retail merchandise and may be a post, wall or other structural barrier. The front stop 28 may take the form of a transparent or opaque wall structure that includes an upright portion 36 integrally connected to a generally horizontal base portion 38, which may include an elongated slot 48 thereon. The upright portion extends between a front face 40 and a rear face 42. The front face 40 is directed away from the retail merchandise while the rear face 42 is directed toward, and engages with, the retail merchandise. The horizontal base portion 38 extends between an upper face 44 directed upwardly toward the retail merchandise 12 and a lower face 46 directed toward, and generally coplanar with the top surface 14 of the retail shelf 16. In the illustrated embodiment, the upright and base portions 36, 38 are integrally formed with and transverse to each other. In addition, the horizontal portion 38 extends rearwardly away from the rear face 42. The front stop thus serves as a barrier to maintain the retail merchandise within the retail merchandise channel and prevent the retail merchandise from falling out. Preferably, the front stop is transparent to allow viewing of the merchandise.

As illustrated in FIG. 2, the elongated slot 48 extends the length of the front stop 28, and is configured for receiving a corresponding projection 50 of the front mounting rail 34. As a result of the attachment, the front mounting rail 34 is integral to the front stop 28. However, the front mounting rail 34 may also be affixed to the front stop 28 by other methods, such as a snap fit connection, wherein a female feature of the front mounting rail snaps to a male feature located on the upper face 40 of the base portion 38 of the front stop 28. While a separate rail has benefits and features, in other embodiments, the front mounting rail 34 and front stop 28 may be manufactured as a single component and as such, the front mounting rail 34 and the front stop 28 are unitarily formed.

The front face 40 of the upright portion 36 of the front stop 28 is typically flush with the front edge 18 of the retail shelf 16 (See FIG. 1). The base portion 38 of the front wall structure 28 includes apertures 54 extending between and through the upper and lower faces 44, 46. These apertures 54 through the base portion 38 are typically aligned with the apertures 26 passing through the top surface 14 of the shelf 16. Once aligned, buttons, pegs, and similar devices are inserted through the apertures 54, 26 to securely hold the retail pusher and divider system 10 in place relative to the shelf 16.

Despite being illustrated as such, the upright portion 36 need not be a completely solid member. For example, in one embodiment, the upright portion 36 is a fence, a slotted member, or another structure known to be used for retaining merchandise. By placing slots or similar features in the upright portion 36, the merchandise 12 is more easily viewed. In one embodiment, all or a portion of the front wall structure 28 is formed from a transparent material to permit viewing of the merchandise 12. A typical front stop 28 extends laterally and parallel to the front edge 18 of the shelf 16 a length of approximately three to twenty four inches, but may exceed twenty four inches in other embodiments.

Also illustrated in FIG. 2 is the front mounting rail 34, having a projection 50 and a rail portion 33 for mounting the partitions and the pusher assembly to the front mounting rail 34. The rail portion 33 includes an interlocking means that allows for the partitions and the pusher to be selectably positioned about the length of the front mounting rail 34 to accommodate differing sizes of retail merchandise. The projection 50 is adapted to correspond to the elongated slot 48 of the front stop 28. The projection 50 is laterally positioned within the elongated slot 48 via entry from the open profile 52 of the slot.

As depicted in FIG. 2, the rail portion includes an interlocking means that may comprise, but is not limited to, a plurality of vertical serrations 58. The means for interlocking may also include other configurations such as a plurality of holes in the rail adapted to receive a corresponding peg, or a plurality of horizontal serrations adapted to receive a corresponding male feature. The interlocking feature of the front mounting rail 34 prevents the partitions 30 and the pusher assembly 32 from laterally shifting along the axis of the front mounting rail 34.

The front mounting rail 34 need only be integral with the front stop 28, and as such it is not limited to existing as a separate component as shown in FIG. 2, but may also be formed as a unitary component with the front stop 28. However, a benefit to using separate components for the front stop 28 and the front mounting rail 34 is that the front mounting rail may be formed from a material having a greater elasticity than the front stop, allowing for easier connection of the partitions and the pusher assembly while maintaining a rigid front stop to maintain the retail merchandise. The front mounting rail is typically formed from a plastic, and may extend laterally and parallel to the length of the front stop approximately three to twenty four inches, but may exceed twenty four inches in other embodiments. Additionally, while the front stop may be transparent or some opaque color, the mounting rail 34 can be transparent or some opaque color as well.

Figure 3:
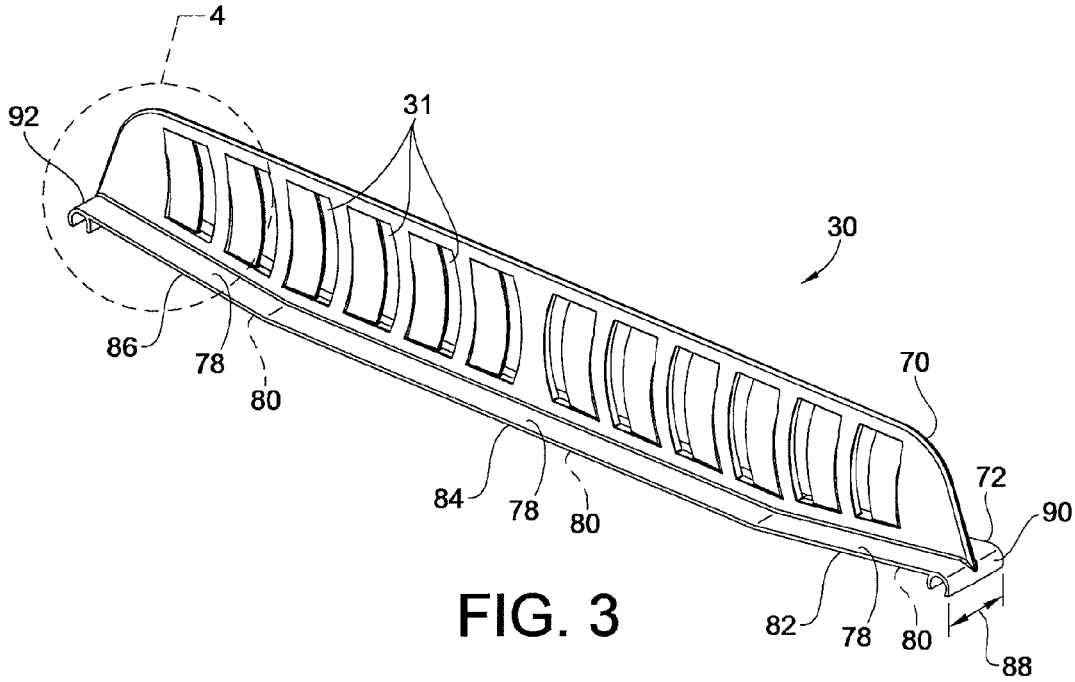
FIG. 3 is a top and back perspective view of one of the partition walls of the retail pusher and divider system of FIG. 1.

Referring now to FIG. 3, one of the partitions 30 from FIG. 1 is illustrated. The partition 30 defines a generally upright portion 70 that extends upward from a base portion 72. The base portion 72 has a width 88 and extends between a product support surface 78 directed upwardly toward the retail merchandise 12 and a lower face 80 directed toward, and generally engaged with and resting upon, the shelf 16. In the illustrated embodiment, the upright and horizontal portions 70, 72 are integrally formed with and transverse to each other. As best shown in FIG. 3, partitions 30 resemble an inverted "T-beam" in the illustrated embodiment. Due to this configuration, each of the partitions 30 processes substantial rigidity. This rigidity and structural integrity inhibits the partitions 30 from bowing or bending outwardly away from the merchandise 12 as the product is pushed forward in the retail merchandise channel 22. Therefore, the partitions 30 serve as walls for containing the retail merchandise. Depending on the amount of rigidity required for the particular application, the width 88 of the base portion 72 is increased or decreased as needed. The partitions may also incorporate a plurality of ribbed cut outs 31 passing through the upright portion 70.

As illustrated in FIG. 3, the product support surface 78 of the base portion 72 of the partition 30 has three sections. A first ramp section 82, a base section 84, and a second ramp section 86. The base section 84 is generally coplanar with the top surface 14 of the retail shelf 16. The base section is sandwiched between the first and second ramp sections 82, 86. The first and second ramp sections 82, 86 extend from either end of the base section 84 upwardly and angularly away from the retail shelf top surface 14. The top surfaces of sections 82, 84, 86 together comprise the product support surface 78. As illustrated, the partitions 30 may be manufactured to be symmetrical such that the first or the second ramp section 82, 86 is operably connected to the front mounting rail 34. As will be discussed more fully below, the retail merchandise 12 is pushed along the central axis of the retail merchandise channel 22 and toward the front stop 28 under the action of the pusher assembly 32. While being pushed, the merchandise is ramped on either the first or second ramp sections 82, 86 upward and away form the top surface 14 of the shelf 16 (see FIG. 1).

Figure 4:
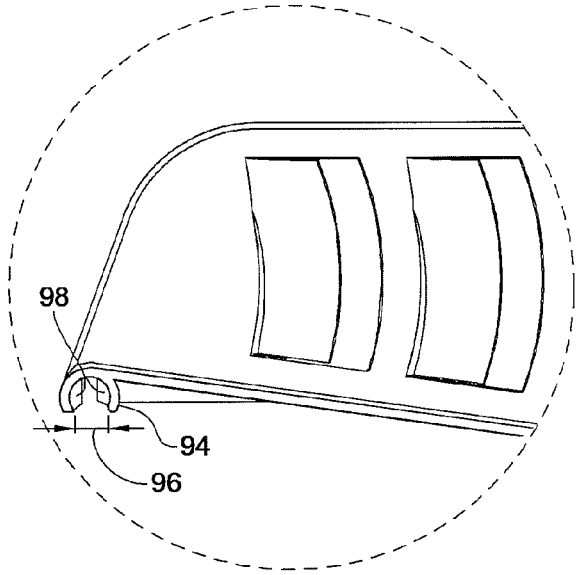
FIG. 4 is a detail view of an end of a partition shown in FIG. 4.

Also shown in FIG. 3, the partition includes a first and second partition mounting clip 90, 92 located proximate to the peripheries of the first and second ramped sections 82, 86 (i.e. the highest point of the ramp sections 82, 86 relative to the shelf top surface 14) respectively. As shown in detail in FIG. 4, a typical partition mounting clip is shown having a unshaped channel 94, with a narrower opening 96 than the diameter of the partition mounting clip 92. Contained within the channel 94 is at least one locking tab 98. The locking tabs 98 correspond to the serrations 58 of the front mounting rail 34, and when mounted, reside between the channel defined by two adjacent serrations. However, the partition mounting clip channel 94 may contain other structures for interlocking the partition to the front mounting rail, such as a peg or horizontal locking tab. As shown, the partition mounting clips 90, 92 are used to interlock the partition 30 to the front mounting rail 34.

Referring back to FIG. 1, each of the pair of partitions 30 is secured to the front mounting rail 34 and as such are proximate to the front stop 28. When the partitions 30 and the front stop 28 are secured via the front mounting rail 34, the partitions are in opposed spaced relation to each other. Therefore, as will be more fully explained below, the partitions 30 are able to guide the retail merchandise 12. In addition, the partitions 30 are transverse to, and extend rearwardly from, the front stop 28 to define a retail merchandise channel 22 (see FIG. 1) for the retail merchandise 12. Despite being interlocked to the front mounting rail 34, the partitions 30 are laterally moveable either toward or away from each other to increase or decrease the size of the retail merchandise channel 22 to accommodate a variety of different sizes of retail merchandise 12. The partition mounting clips 90, 92 in combination with the serrations 58 of the front mounting rail ensure that unwanted movement of one of the partitions 30 relative to the other partition does not occur after the partitions have been suitably positioned and interlocked. The fit of the partition mounting clips 90, 92 and the front mounting rail 34 is snug enough to prevent the partitions from moving out of place during use, but also allows a worker to manually readjust the relative spacing of the partitions without special tools. The partitions 30 are typically made from a formed plastic, and may range in length from approximately one to thirty six inches and be in opposed space relation to each other approximately two to twenty four inches, but may exceed these values in other embodiments.

Figure 5:
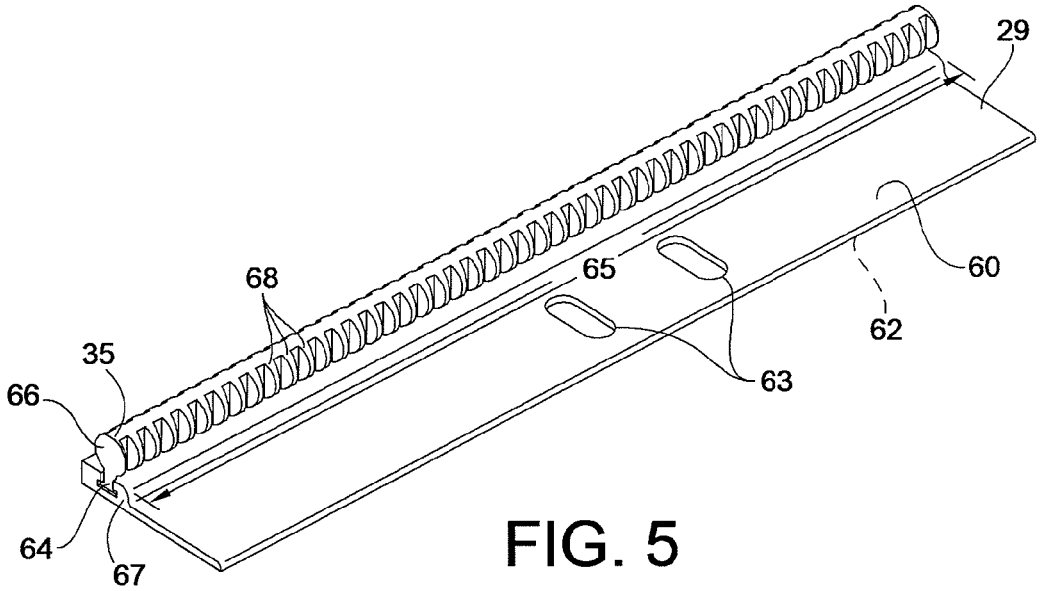
FIG. 5 is a perspective view of the rear mounting rail and rear base member of the retail pusher and divider system of FIG. 1.

Referring now to FIG. 5, a rear base member 29 may also be utilized in the retail pusher and divider system. The rear base member extends between a top surface 60 directed toward the retail merchandise, and a bottom surface 62 directed toward and coplanar with the top surface 14 of the retail shelf 16.

The rear base member 29 may include an elongated slot 65 for affixing a rear mounting rail 35 to the rear base member 29. As shown in FIG. 5, the elongated slot 65 is configured for receiving a corresponding projection 64 of the rear mounting rail 35. However, the rear mounting rail 35 may also be affixed to the rear base member 29 by other methods, such as a snap fit connection, wherein a female feature of the rear mounting rail snaps to a male feature located on the top surface 60 of the rear base member 29. The rear mounting rail 35 may also be formed integrally with the rear base member 29 and as such, the rear mounting rail 35 and the rear base member 29 exist as a single unit.

The rear base member 29 includes a plurality of apertures 63. These are typically aligned with the apertures 26 passing through the top surface 14 of the shelf 16. Once aligned, buttons, pegs, and similar devices are inserted through the apertures 63, 26 to securely hold the retail pusher and divider system 10 in place relative to the shelf 16.

Also shown in FIG. 5 is the rear mounting rail 35, having a projection 64 and a rail portion 66 for mounting the end of the partitions 30 opposite to the end mounted to the front mounting rail 34. The rail portion 66 includes an interlocking means that allows for the partitions 30 to be selectably positioned about the length of the rear mounting rail 35 to accommodate differing sizes of retail merchandise. The projection 64 is adapted to correspond to the elongated slot 65 of the rear base member 29. The projection 64 is laterally positioned within the elongated slot 65 via entry from the open profile 67 of the slot.

As depicted in FIG. 5, the rail portion 66 includes an interlocking means that may comprise, but is not limited to, a plurality of vertical serrations 68. The means for interlocking may also include other configurations such as a plurality of holes in the rail portion 66 adapted to receive a corresponding peg, or a plurality of horizontal serrations adapted to receive a corresponding male feature. The interlocking feature of the rear mounting rail 35 prevents the partitions 30 from laterally shifting along the axis of the rear mounting rail 35.

The rear mounting rail 35 need only be integral with the rear base member 29, and as such it is not limited to existing as a separate component as shown in FIG. 2, but may also be formed as a unitary component with the rear base member 29. However, a benefit to using separate components for the rear base member 29 and the rear mounting rail 35 is that the rear mounting rail may be formed from a material having a greater elasticity than the rear base member, allowing for easier connection of the partitions while maintaining a rigid base member. The rear mounting rail is typically formed from a plastic, and may extend laterally and parallel to the length of the rear base member approximately three to twenty four inches, but may exceed twenty four inches in other embodiments.

Figure 6:
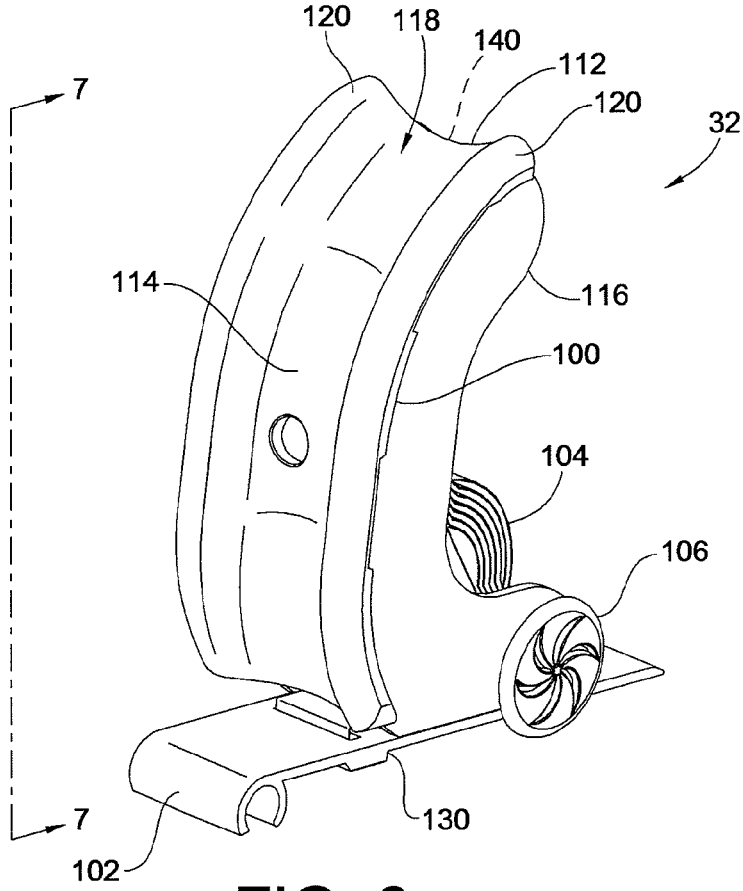
FIG. 6 is a perspective view of the pusher assembly of the retail pusher and divider system of FIG. 1.
Figure 7:
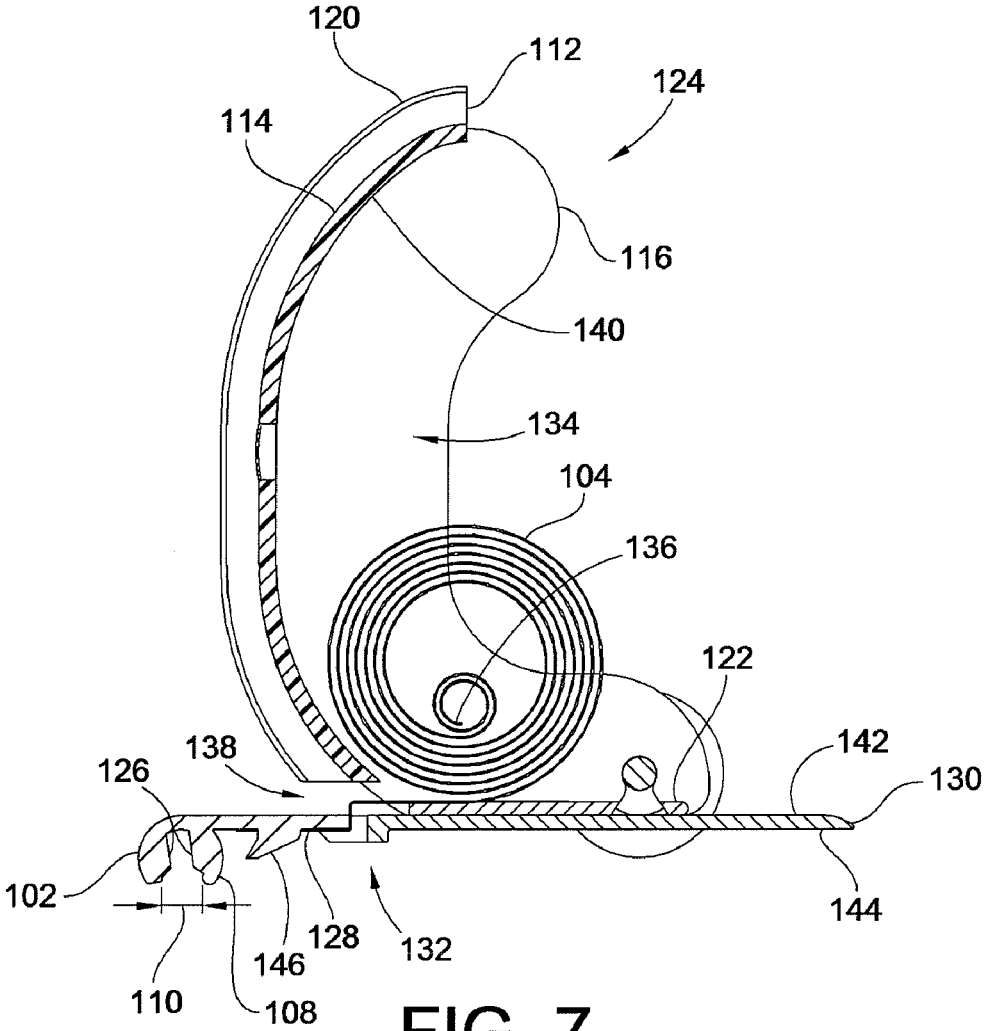
FIG. 7 is a cross sectional view of the pusher assembly shown in FIG. 6.

Referring now to FIGS. 6 and 7, one embodiment of a typical pusher assembly 32 is shown comprising a pusher body 100, a pusher mounting clip 102 disposed of below the pusher body, a spring element 104 housed within the pusher body, and at least one wheel 106 operatively connected to the pusher body to allow the pusher assembly 32 to be wheeled toward and away from the front stop 28. The pusher assembly 32 biases the retail merchandise 12 within the retail merchandise channel 22 forward until the front most unit is in contact with the front stop.

The pusher body 100 has a front wall 112 with a front and rear face 114, 140, and a pair of side walls 116 in opposed spaced relation to each other. The side walls 116 extend rearwardly from and are generally transverse to the front wall 112. The front face 114 faces the rear face 42 of the upright portion 36 of the front stop 28. The pusher body 100 possesses a radial profile due, in large part, to the curved front wall 112. The front face 114 of the pusher front wall 112 includes a concave upright or vertical channel 118 defining a pair of spaced-apart, curved edges 120. Each of the channel and edges 118, 120 extends from near a pusher body bottom 122 to an open top 124 (See FIG. 7). The channel and curved edges 118, 120 act to center the pusher assembly against the retail merchandise 12 by maintaining two balanced points of contact with the retail merchandise. In one embodiment, the pusher body bottom 122 of the spring chamber 134 includes an indicia, label, and/or marking indicating a strength of the spring element 104. For example, one of the letters "H", "M", or "L" is placed on the pusher body bottom 122 to indicate that the spring element 104 has a high, medium, or low spring force, respectively. The strength indicator may also be suitably located elsewhere on the pusher body 100 such as, for example, on a one of the side walls 116. Although the pusher body 100 as illustrated has a front wall 112 having a concave front face 114, the pusher body may also have a flat front face, such as that depicted in U.S. Pat. No. 6,889,654 to Valiulis, assigned to the instant assignee. The pusher body is typically made from a formed plastic and has an overall height of approximately two to eight inches, but may exceed eight inches in other embodiments.

The pusher mounting clip 102 defines a u-shaped channel 108 having a narrower opening 110 than the diameter of the mounting clip 102. Contained within the u-shaped channel is at least one locking tab 126. The locking tabs 126 correspond to the serrations 58 of the front mounting rail 34, and when mounted, reside between the channel defined by two adjacent serrations. However, the partition mounting clip channel 108 may contain other structures for interlocking the partition to the front mounting rail, such as a peg or a horizontal tab. Once the pusher mounting clip 102 is interlocked to the front rail 34, the pusher assembly is prevented from lateral shifting about the axis of the front mounting rail 34. The fit of the pusher mounting clip 102 and the front mounting rail 34 is snug enough to prevent the pusher assembly from moving out of place during use, but also allows a worker to manually readjust the location of the pusher assembly without special tools. The pusher mounting clip is typically made from a formed plastic.

The front wall 112, side walls 116, open top 124, and pusher body bottom 122 together form a spring chamber 134. The spring element 104 resides within the spring chamber 134. In the illustrated embodiment, a first end 136 of the spring element 104 remains unattached to the pusher body 100 while a second end 128 projects out of the pusher body through a bottom aperture 138. Still referring to FIG. 6 and FIG. 7, the bottom aperture 138 is formed at an intersection of the curved forward face 114 and the pusher body bottom 122. Once clear of the pusher body 100, the second end 128 travels over a rear portion 130 of the mounting clip 102. The second end 128 next passes through an aperture 132 formed in the mounting clip 102. As illustrated, the aperture 132 extends between upper and lower surfaces 142, 144 of the mounting clip rear portion 130 and provides a passageway for the spring element 104 through the mounting clip 102. After the second end 128 passes through the aperture 132, the second end bends upwardly to engage a portion of the lower surface 144. As shown, the second end 128 may engage a post 146 depending downwardly from the lower surface 144 of the mounting clip 102. As shown, the second end 128 is generally secured to the mounting clip 102. In this arrangement, the mounting clip 102 and the spring force of the spring element 104 cooperate to maintain the spring element within the spring chamber 134 and keep the spring element biased against the rear face 140 of the pusher body 100.

Figure 8:
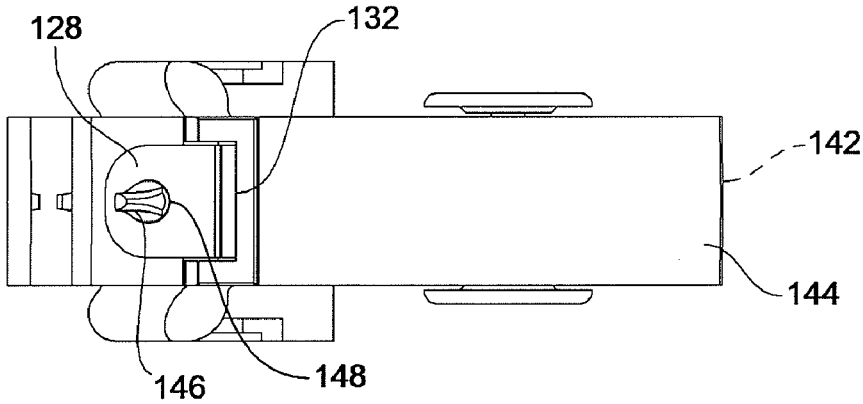
FIG. 8 is a bottom view of the pusher assembly of FIG. 6

As illustrated in FIG. 8, the post 146 passes through and mates with an aperture 148 formed in the second end 128 of the spring element 104. In one embodiment, the post 146 and the second end 128 of the spring element 104 are coupled together by heat staking, a sonic weld process, or another known coupling method. As illustrated in FIG. 7, the spring element 104 is a spiral spring, however other biasing elements may be utilized, for example an elastic material. In the illustrated embodiment, the spiral spring 104 is a thin, flat strip of metal that has been wrapped around itself.

Figure 9:
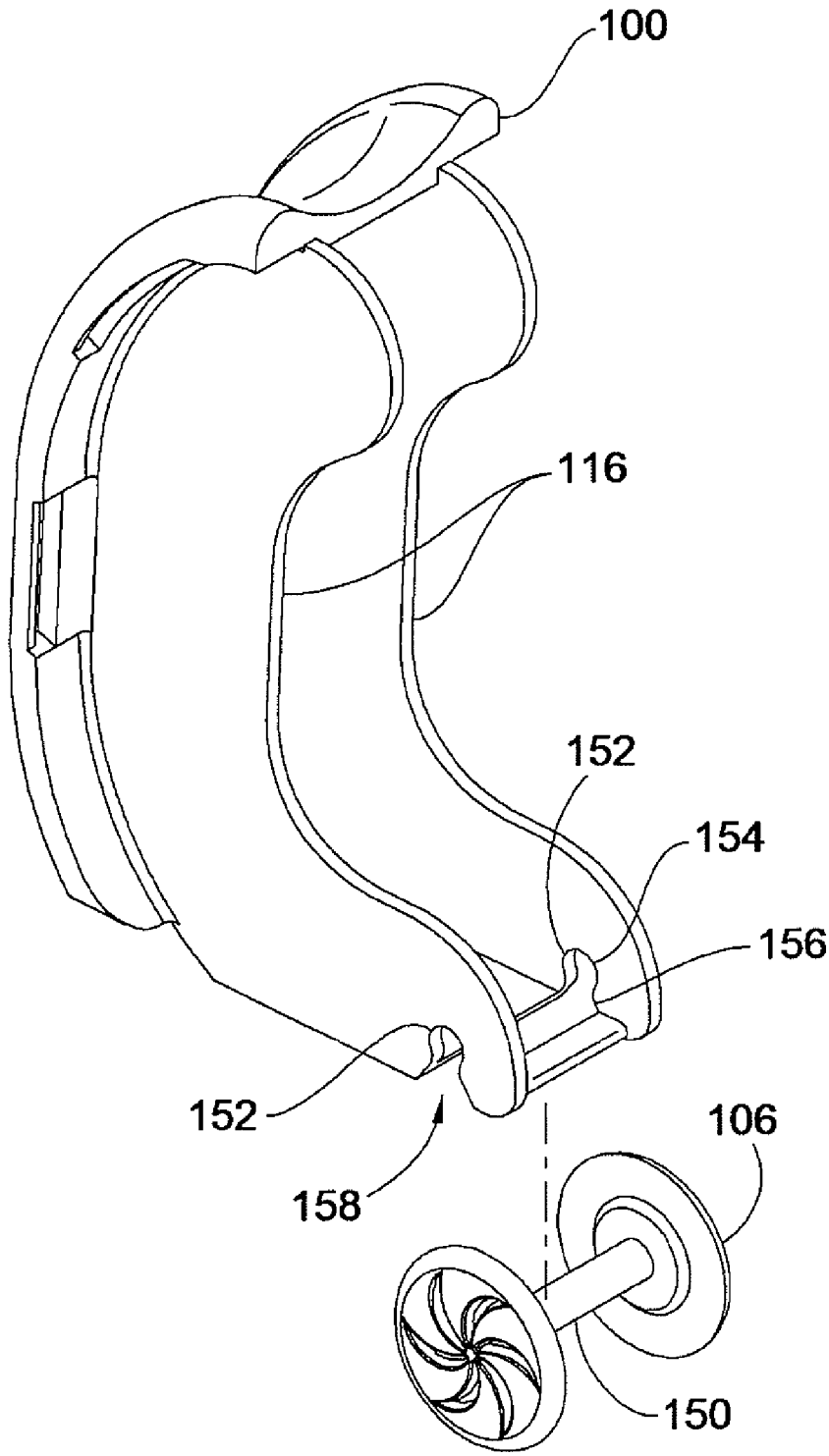
FIG. 9 is a top and back assembly perspective view of the pusher body, axle and wheels of the pusher of FIG. 6.

Turning now to FIG. 9, a pusher body 100 is shown in a disassembled state in combination with a pair of wheels 106 and an axle 150. In the illustrated embodiment, the axle 150 passes through the pusher body side walls 116 via notches 152. Depicted as shown, the notches 152 have an axle receiving portion 154, and a tapered portion 156 leading inward and toward the axle receiving portion. There exists an opening 158 at the union of the axle receiving portion 154 and the tapered portion 156. The opening 158 is smaller than the diameter of the axle 150. The axle receiving portion 154 has a radial profile with a diameter substantially similar to the diameter of the axle 150. The axle may enter the notch 152 via the tapered portion 156, and be pressed through the opening 158. Once the axle 150 is pressed through the opening 158, it resides in the axle receiving portion 154 and is prevented from falling out of the notch 152 by virtue of the size differential between the diameter of the axle 150 and the opening 158. The axle receiving portion 154 and the axle 150 are mated in a clearance fit orientation such that the axle is free to rotate once interlocked in the axle receiving portion. Once interlocked, the axle 150 extends laterally outward and generally perpendicular to both the sidewalls 116. The axles may also be interlocked to the pusher body 100 by a closed circular profile that allows the axle to freely slide through and rotate within, or as another example, a split block arrangement, where the axle is trapped between two separate components, yet still free to rotate.

Once interlocked, the portions of the axle 150 exposed exterior to the sidewalls 116 may be used for mounting the wheels 106. In the illustrated embodiment, the wheels 106 and axle 150 are manufactured as a single component, such that rotation of the axle 150 results in a corresponding rotation of the wheels 106. As illustrated, the axle 150 and wheels 106 are formed as a single component and interlocked to the pusher body 100 via the notches 152 such that the wheels are exterior to the pusher body 100 side walls 116. Although illustrated as a single component, the wheels and axle may be manufactured and assembled as separate components as well. When manufactured separately, the wheels 106 may be mounted to the axle 150 via a number of known methods such as a snap fit connection, or a bearing assembly. The axle 150 and wheel 106 subassembly may then be interlocked within the notches 152. Also, the wheels 106 may be connected to the axle 150 after the axle has been interlocked in the notches 152. Although an axle 150 is shown in the illustrated embodiment, it is not required for wheeled operation of the pusher assembly 32, as the wheels 106 may be connected directly to the pusher body without the use of the axle 150, for example, by mounting each wheel to a hub protruding laterally outward and perpendicular to each of the side walls 116. In such a configuration, the wheels 106 would rotate about the hubs as opposed to rotating with an axle. It should also be noted that the pusher assembly may include only one wheel, despite the two wheeled embodiment shown in FIG. 9.

Figure 10:
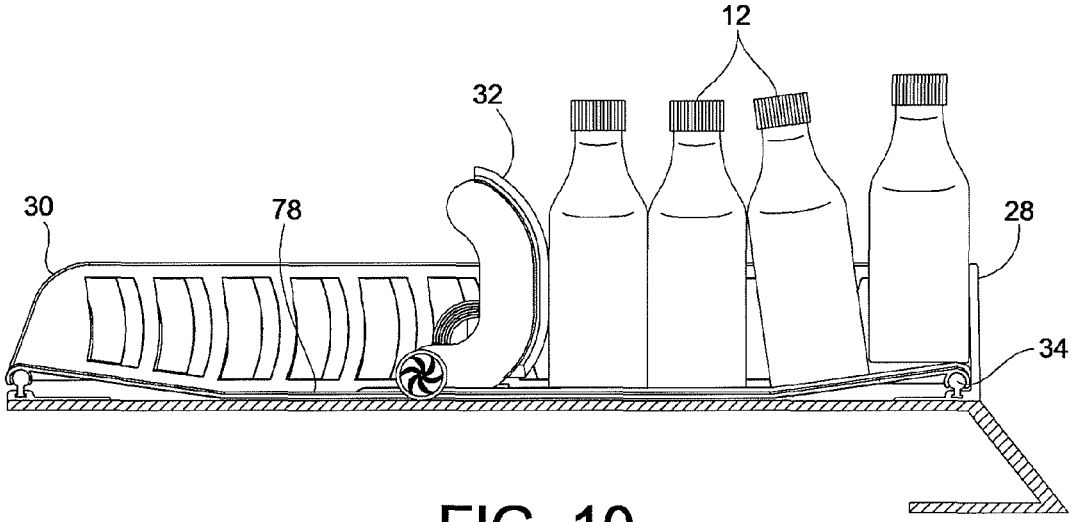
FIG. 10 is a side perspective view of the retail pusher and divider system of FIG. 1, with a closest one of the partitions of FIG. 4 removed.

Referring now to FIG. 10, a pusher assembly 32 within the divider system is shown, with on partition 30 removed for clarity. After the pusher assembly 32 has been mounted to the front mounting rail 34 by use of the pusher mounting clip 102, the pusher assembly 32 is wheeled away from the front stop 28 by virtue of the wheels 106. This action causes more of the spring element 104 to be drawn out of the pusher body 100 through the pusher bottom aperture 138. The further back the pusher assembly 32 is moved, the more an unwound portion of the spring element 104 is extracted. The unwound portion of the spring element 104 is disposed below the retail merchandise 12 and the product support surface 78 (see FIG. 3). The product support surface 78 elevates the retail merchandise 12 such that the unwound portion of the spring element 104 is free to be extracted and retrieved into the pusher body 100 without interference.

When the foremost item of retail merchandise 12 is extracted from the retail pusher and divider system 10, the spring element 104 biases the pusher assembly 32 and the remaining retail merchandise 12 forward toward the front stop 28. The remaining items of retail merchandise 12 slide over and upon the ramped 82, 86 and base sections 84. At the same time, some of the spring element 104 retreats into the spring chamber 134 and gets wrapped about the rest of the spring element. This process continues until all of the retail merchandise 12 has been removed from the retail pusher and divider system 10. To refill the retail pusher and divider system 10, the retail merchandise 12 is forced between the front stop 28 and the pusher assembly 32. When this occurs, the pusher assembly 32 is biased away from the front stop 28 to make room for the retail merchandise 12 in the retail merchandise channel 22 and the spring element 104 is unwound. As more items are added, the capacity of the retail merchandise channel 22 is enlarged by moving the pusher assembly 32 back away from the front wall structure 28 and further unrolling of the spring element occurs 104.

Additionally, it should be noted that the pusher assembly 32 is free of a central track. Instead, the pusher assembly 32 can hook directly on the front mounting rail 34. The partitions 30 may be spaced at a span substantially equal to the width of the pusher assembly 32 such that the pusher assembly wheels 106 engage with and are guided by the base portions 72 of the partitions 30. In such a circumstance, the retail merchandise channel 22 may only be as wide as the lateral span/width of the pusher assembly 32. Alternatively, the partitions 30 may be spaced wider such that the pusher assembly 32 may not directly contact the base portion 72 of the partitions 30. In this situation, the pusher assembly 32 will tend to self center on retail merchandise due to the channel 118 and two curved edges 120 of the front face 114. As a result, the partitions 30 indirectly guide and/or indirectly engage (e.g. through the merchandise) the pusher assembly 32.

Figure 11:
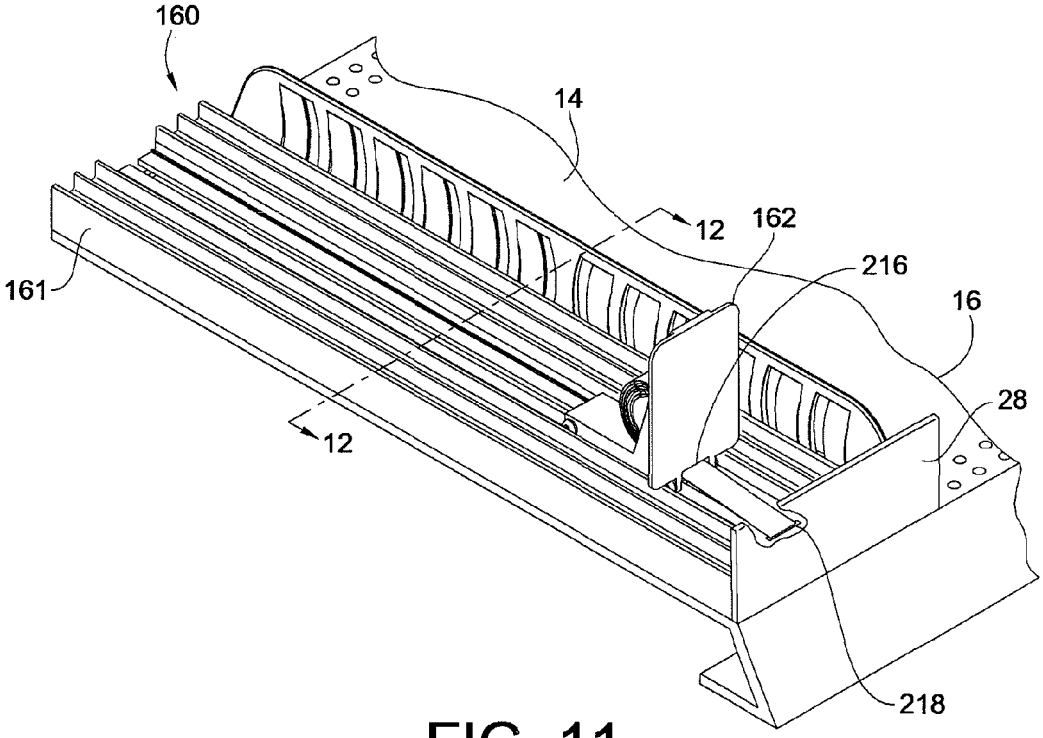
FIG. 11 is a retail pusher and divider system incorporating the rail assembly, with the closest on of the partitions of FIG. 4 removed.

Moving now to FIG. 11, a retail pusher and divider system is shown with an additional rail assembly 160, disposed of in an area bounded by the partitions 30, (one of which has been removed for a more clear illustration) and the front stop 28. The rail assembly 160 rests upon the top surface 14 of the retail shelf 16. As shown in FIG. 11, the rail assembly is interposed within the retail pusher and divider system as described above, however, it will be recognized that the rail assembly may be utilized in other divider systems, such as that of U.S. Pat. No. 5,971,173 to Valiulis assigned to the instant assignee.

The rail assembly 160 comprises a rail member 161 and a pusher assembly 162. The pusher assembly is free to move along the length of the rail member in order to face retail merchandise 12. The retail merchandise 12 (see FIG. 1) rests upon the rail member and is biased forward toward the front stop 28 under the action of the pusher assembly 162. The rail assembly thus provides an additional product support surface other than the top surface 14 of the retail shelf 16 for supporting the retail merchandise 12.

Figure 12:
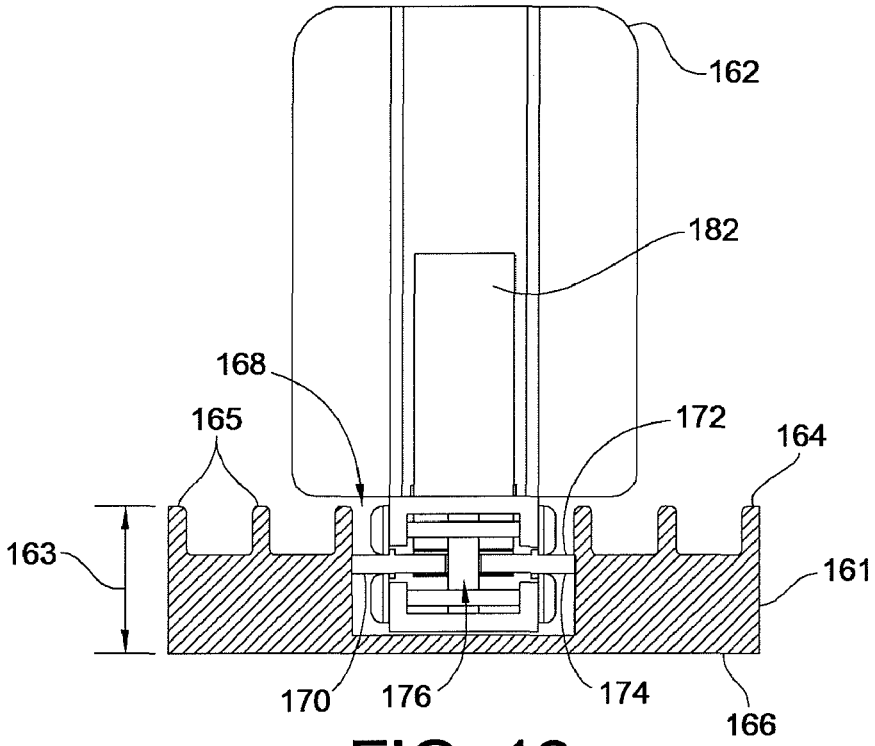
FIG. 12 is a cross sectional view of the pusher assembly and rail member of FIG. 11.

Moving now to FIG. 12, the rail member 161 extends between a top surface 164 and a bottom surface 166. The top surface is in contact with the retail merchandise 12 while the bottom surface is coplanar with the top surface 14 of the retail shelf 16. A channel 168 extends inward from the top surface 164 and through a portion of the rail member thickness 163. The top surface 164 may be configured with a variety of surface features, such as a plurality of ribs 165 as in the illustrated embodiment. As illustrated in FIG. 12, configuring the top surface 163 to have a plurality of ribs 165 will reduce the surface area of contact between the retail merchandise and the product support surface. Therefore an additional benefit to incorporating a ribbed rail assembly is a reduction in the heat transfer between the rail member 161 and the retail merchandise 12 during its movement toward the front stop.

Still referring to FIG. 12, the rail member 161 channel 168 has a channel bottom 170. The channel bottom has a top surface 172 and a bottom surface 174. A slot 176 is centered in the channel bottom 170, and extends between and through the top and bottom surfaces 172, 174. The slot 176 can have a length equal to or less than the overall length of the rail member 161. The channel 168, in combination with the slot 176 located at the channel bottom 170 provide an area for the pusher assembly 162 to be wheeled toward and away from the front stop upon the rail member 161.

As shown in FIG. 11 The rail member 161 is located upon the retail shelf 16 between the partitions 30, the front stop 28. Configured as shown, the rail member width 178 defines the minimum distance between the partitions 30. It should be noted however, that the partitions 30 may be spaced far enough apart to accommodate multiple adjacent rail assemblies 160 in order to facilitate the facing of larger retail merchandise.

As noted above, although depicted with the instant retail pusher and divider system disclosed, when incorporated into the rail assembly 160, the rail member 161 may be utilized in a variety of existing divider systems. A typical rail member is made from plastic, and extends a length of approximately one to thirty six inches, but may exceed six inches in other embodiments.

Figure 13:
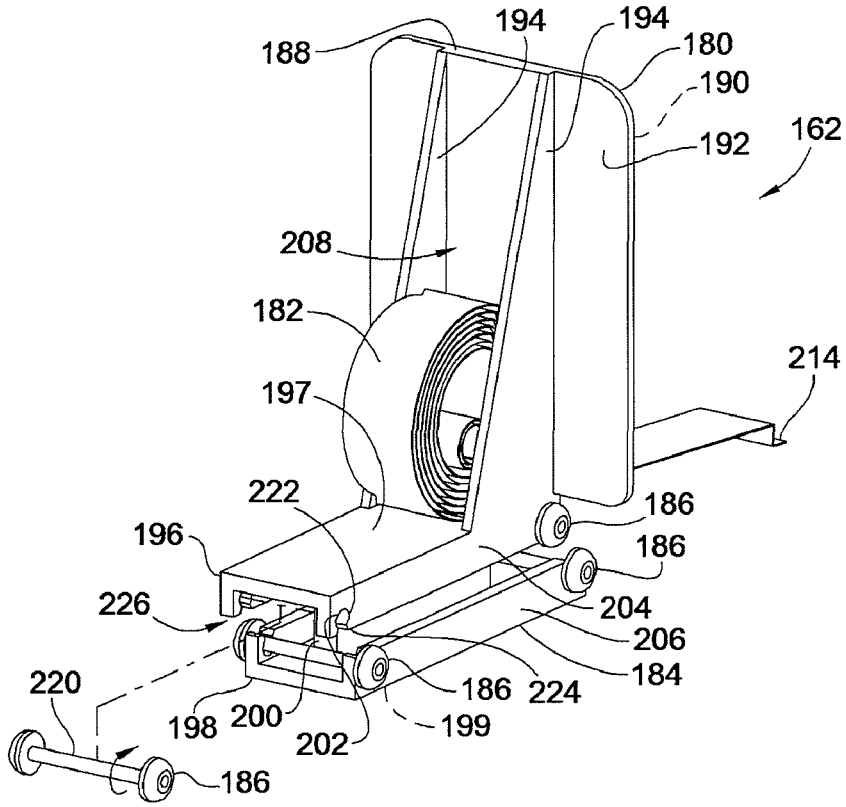
FIG. 13 is a top and back assembly perspective view of the pusher assembly of FIG. 11.

Referring now to FIG. 13, a pusher assembly 162 is shown having a pusher body 180, a spring element 182 contained within the pusher body, a pusher retaining body 184 disposed of below the pusher body, and at least one wheel 186 operatively connected to the pusher retaining body to allow the pusher assembly to be wheeled toward and away from the front stop 28. The pusher assembly 162 resides within the channel 168 of the rail member 161 and biases the retail merchandise 12 (see FIG. 1) forward.

The pusher body 180 comprises a front wall 188 extending between a front face 190 directed towards the rear face 42 of the upright portion 36 of the front stop 28, and a rear face 192 and side walls 194 extending rearwardly from and generally perpendicular to the front wall 188. The pusher body 180 is disposed above and may be integral with the pusher retaining body 184, and extends generally upright thereto. The pusher body 188 is in engageable contact with the retail merchandise 12 as it travels forward in the retail merchandise channel 22.

The pusher retaining body 184 comprises an upper flange 196, a lower flange 198, and a support member 200 disposed of between the flanges 196, 198. The support member 200 is generally perpendicular to and joins the flanges 196, 198. The pusher retaining body 184 generally has the cross sectional profile of an "I" beam. The upper flange has a top surface 197 which faces the pusher body, and upper side walls 204 extending downwardly from the top surface 197 and generally perpendicular thereto. The lower flange has a lower surface 199 which faces the top surface 14 of the retail shelf 16, and lower side walls 206 extending upwardly from the lower surface 199 and generally perpendicular thereto. The pusher retaining body acts to retain the pusher assembly 162 within the channel 168 by sliding the support member 200 into the slot 176 located at the channel bottom 170. Once installed, the pusher retaining body is free to slide within the slot. However, by virtue of the flanges 196, 198 the pusher retaining body is prohibited from being vertically removed from the channel because the slot 176 is not wide enough to allow the lower flange 198 to pass through it.

The front wall 190, side walls 194, and the top surface 197 of the upper flange 196 together form a spring chamber 208 for housing the spring element 182. In the illustrated embodiment, a first end 212 of the spring element 182 remains unattached to the pusher body 180 while a second end 214 projects out of the pusher body through a bottom aperture 216 (See FIG. 11). The bottom aperture 216 is formed at an intersection of the pusher body front wall 188 and the upper surface 197 of the upper flange 196. Once clear of the pusher body 180, the second end 214 travels forward within the channel 168 and passes through an aperture 218 formed in the channel bottom 170. The aperture 218 extends between and through the channel bottom top and bottom surfaces 172, 174. After the second end 214 passes through the aperture 218, the second end bends upwardly to engage a portion of the bottom surface 174. The second end 214 is crimped once through the aperture 218 to prevent it from retreating back through the aperture under the force of the spring element 182. In this arrangement, the spring force of the spring element 182, and the spring chamber 208 cooperate to maintain the spring element within the spring chamber and keep the spring element biased against the rear face 192 of the pusher body front wall 188.

Still referring to FIG. 13, the pusher body 180 is shown in an exploded state in combination with 4 pairs of wheels 186 and four axles 220. In the illustrated embodiment, two axles 220 pass through the upper side walls 204 of the upper flange 196, and two axles 220 pass through the lower side walls 206 via notches 202. Depicted as shown, the notches 202 have an axle receiving portion 222, and a tapered portion 224 leading inward and toward the axle receiving portion. There exists an opening 226 at the union of the axle receiving portion 222 and the tapered portion 224. The opening 226 is smaller than the diameter of the axle 220 to be seated in the axle receiving portion. The axle receiving portion 222 has a radial profile with a diameter substantially similar to the diameter of the axle 220. The axle may enter the notch 202 via the tapered portion 224, and be pressed through the opening 226. Once the axle 220 is pressed through the opening 226, it resides in the axle receiving portion 222 and is prevented from falling out of the notch 202 by virtue of the size differential between the diameter of the axle 220 and the opening 226. The axle receiving portion 222 and the axle 220 are mated in a clearance fit orientation such that the axle is free to rotate once interlocked in the axle receiving portion. Once interlocked, each axle 220 extends laterally outward and generally perpendicular to the upper and lower sidewalls 204, 206. The axles may also be interlocked to the pusher retaining body 184 by a closed circular profile that allows the axle to freely slide through and rotate within, or as another example, a split block arrangement, where the axle is trapped between two separate components, yet still free to rotate.

Once interlocked, the portions of the axles 220 exposed exterior to the sidewalls 194 may be used for mounting the wheels 186. In the illustrated embodiment, the wheels 186 and axles 220 are manufactured as a single component such that rotation of the axles 220 results in a corresponding rotation of the wheels 186. As illustrated, the axles 220 and wheels 186 are formed from a single component and interlocked to the pusher retaining body 184 via the notches 202 such that each pair of wheels is exterior to the upper and lower flange side walls 204, 206. Although illustrated as a single component, the wheels and axles may also be manufactured and assembled as separate components as well. When manufactured separately, the wheels 186 may be mounted to the axles 220 via a number of other known methods such as a snap fit connection, or a bearing assembly, and the axle 220 and wheels 186 subassembly may then be interlocked within the notches 202. Also, the wheels 186 may be connected to the axles 220 after the axle has been interlocked in the notches 202. Although axles 220 are shown in the illustrated embodiment, they are not required for wheeled operation of the pusher assembly 162, as the wheels 168 may be connected directly to the pusher body without the use of the axles 220, for example, by mounting each wheel to a hub protruding laterally outward and perpendicular to each of the side walls 194. In such a configuration, the wheels 186 would rotate about the hubs as opposed to rotating with an axle. It should also be noted that the pusher assembly may use only one wheel operably connected to each of the flanges 196, 198 despite the two wheeled embodiment shown in FIG. 13.

As the pusher assembly 162 is wheeled away from the front stop 28, the spring element 182 is drawn out of the pusher body 180 through the pusher body aperture 216. The further back the pusher assembly 162 is moved, the more an unwound portion of the spring element 182 is extracted. The unwound portion of the spring element 182 is disposed below the rail member top surface 164. The rail member 161 elevates the retail merchandise 12 such that the unwound portion of the spring element 182 is free to be extracted and retrieved into the pusher body 180 without interference. The retail pusher and divider system according to this embodiment may be loaded and unloaded with retail merchandise as described above.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail pusher and divider system for retail merchandise, comprising:

a front stop;

a pair of partitions adapted to provide in combination with the front stop merchandise channel therebetween, the merchandise channel extending toward the front stop;

a pusher assembly interposed in said merchandise channel and movable toward and away from the front stop;

the pusher assembly including at least one wheel allowing for wheeled translation of the pusher assembly toward and away from the front stop;

a pusher body defined by a front wall having a front face which faces the front stop, said front face being in contact with the retail merchandise, a pair of sides in opposed space relation to each other and transverse to the front wall, an open top, and a bottom, wherein the front wall, side walls, open top, and bottom form a spring chamber;

at least one axle connected to the at least one wheel;

a spring element being held within the spring chamber, the spring element having a distal end protruding through an aperture in the pusher body, the distal end of the spring element being secured proximate to the front stop, wherein the spring element is increasingly unwound as the pusher assembly is moved away from the front wall, and rewound as the pusher assembly is moved toward the front wall.

2. The retail pusher and divider system of claim 1, wherein the spring element is a spiral spring.

3. The retail pusher and divider system of claim 1, further comprising a mounting clip secured to the front mounting rail and having a distal end of the spring element being secured to the mounting clip, wherein a projection of the front mounting rail is received in a slot formed in the front stop.

4. The retail pusher and divider system of claim 1 wherein the side walls of the pusher body each have at least one notch for receiving the at least one axle, wherein the at least one axle extends through the notches laterally outward and perpendicular thereto, the axle being interlocked within each of the notches yet capable of rotation once interlocked.

5. The retail pusher and divider system of claim 4 wherein each of the notches includes an axle receiving portion and a mouth leading to the axle receiving portion, the mouth being tapered toward the axle receiving portion and defining an opening narrower than the diameter of the axle, each notch providing a snap fit in which the axle is interlocked, said axle being capable of rotation once interlocked.

6. The retail pusher and divider system of claim 1 wherein at least one wheel is fixedly mounted to the at least one axle such that rotation of the at least one axle results in rotation of the wheel.

7. The retail pusher and divider system of claim 1 wherein the pair of partitions, front stop, pusher body, the at least one axle, and the at least one wheel are constructed of formed plastic, the pusher assembly has a height of two to eight inches, and a linear travel of one to thirty six inches.

8. The retail pusher and divider system of claim 1, further comprising a rail assembly including a rail member having a channel extending inward from a top surface of the rail member and having a channel bottom, the channel bottom having a top and a bottom surface, the channel bottom including a slot, wherein the pusher assembly resides within the channel.

9. The retail pusher and divider system of claim 8 wherein the pusher assembly further includes a channel retaining body disposed of below the front wall of the pusher body and generally perpendicular thereto.

10. The retail pusher and divider system of claim 8 wherein the channel retainer is comprised of:

an upper and lower flange, wherein the upper flange has upper side walls in opposed space relation to each other, the upper flange being disposed of above the channel bottom upper surface, the lower flange has lower side walls in opposed space relation to each other, the lower flange being disposed of below the channel bottom lower surface.

a support member integral to the upper and lower flanges and generally perpendicular thereto, the support member passing through the slot in the channel bottom.

11. The retail pusher and divider system of claim 10 wherein at least one of the at least one axles extends through a notch in each of the upper side walls, the axle extending laterally outward beyond the upper side walls, the notches allowing for free rotation of the at least one axle, wherein the at least one wheel is fixedly mounted to the at least one axle such that rotation of the at least one axle results in rotation of the at least one wheel, the wheel being in contact with the channel bottom.

12. The retail pusher and divider system of claim 11 wherein at least one of the at least one axles extends through a notch in each of the lower side walls, the at least one axle extending laterally outward beyond the lower side walls, and the notches allowing for free rotation of the at least one axle, wherein the at least one wheel is fixedly mounted to the at least one axle such that rotation of the at least one axle results in rotation of the at least one wheel, the wheel being in contact with the channel bottom.

13. A retail pusher and divider system for retail merchandise comprising:

a front stop having an upright portion and base portion, the upright portion extending upward from the base portion;

a front mounting rail integral with the front stop;

a pair of partitions having only a single partition mounting clip at each end of the pair of partitions, the air of partitions being mounted mounting rail and adapted to provide in combination with the front mounting rail a laterally adjustable retail merchandise channel to accommodate varying sizes of retail merchandise;

a pusher assembly, having spring element and a pusher body, the spring element biasing the pusher assembly toward the front stop, the pusher assembly being commonly mounted with the pair of partitions to the front mounting rail via only a single pusher mounting clip;

a rear base member in opposed spaced relation to the front stop and a rear mounting rail formed separately from the rear base member and being mounted thereto, wherein the rear base member includes an elongated slot for receiving a projection of the rear mounting rail, and the rear mounting rail provides a means for interlocking the partition mounting clips of the pair of partitions such that lateral movement of the pair of partitions in the axial direction of the rear mounting rail is prohibited.

14. The retail pusher and divider system of claim 13 wherein the front and rear mounting rails, the pair of partitions, the front stop, the rear base member, and the pusher assembly are made from a formed plastic, the front stop and rear base member extend laterally and generally perpendicular to the pair of partitions a length of three to twelve inches, the pair of partitions extend rearwardly from the front stop a length of six to thirty-six inches and are space apart three to twelve inches, and the front and rear mounting rails extend laterally and generally parallel to the front stop a length of three to twelve inches.

15. A retail pusher and divider system for retail merchandise comprising:

a front stop having an upright portion and a base portion, the upright portion extending upward from the base portion;

a front mounting rail integral with the front stop;

a pair of partitions having only a single partition mounting clip at each end of the pair of partitions, the pair of partitions being mounted to the front mounting rail and adapted to provide in combination with the front mounting rail a laterally adjustable retail merchandise channel to accommodate varying sizes of retail merchandise;

a pusher assembly, having spring element and a pusher body, the spring element biasing the pusher assembly toward the front stop, the pusher assembly being commonly mounted with the pair of partitions to the front mounting rail via only a single pusher mounting clip;

wherein the front mounting rail provides a means for interlocking the partition mounting clip of the pair of partitions and the pusher mounting clip thereto such that lateral movement of the pair of partitions and the pusher assembly in the axial direction of the front mounting rail is prohibited.

16. A retail pusher and divider system for retail merchandise comprising:

a front stop having an upright portion and a base portion, the upright portion extending upward from the base portion;

a front mounting rail integral with the front stop;

a pair of partitions having only a single partition mounting clip at each end of the pair of partitions, the pair of partitions being mounted to the front mounting rail and adapted to provide in combination with the front mounting rail a laterally adjustable retail merchandise channel to accommodate varying sizes of retail merchandise;

a pusher assembly, having spring element and a pusher body, the spring element biasing the pusher assembly toward the front stop, the pusher assembly being commonly mounted with the pair of partitions to the front mounting rail via only a single pusher mounting clip;

wherein the mounting clip has a channel with an entrance region narrower than a diameter of the mounting clip, the channel contains a locking tab therein, and the front mounting rail contains a plurality of serrations along its length, the serrations being mateable with the locking tab.

17. A retail pusher and divider system for retail merchandise comprising:

a front stop having an upright portion and a base portion, the upright portion extending upward from the base portion;

a front mounting rail integral with the front stop;

a pair of partitions mounted to the front mounting rail via a partition mounting clip, each partition having a first ramp section extending upward and away from the retail shelf having a distal end proximate to the front mounting rail, a base section extending rearwardly from the first ramp section and coplanar with the retail shelf, and a second ramp section extending upward and away from the retail shelf with a distal end located at the same elevation as the distal end of the first ramp section, the first, second, and base sections defining a product support surface for supporting retail merchandise that is generally perpendicular to an upright portion of the partitions, wherein the retail merchandise may be positioned above the front mounting rail;

a pusher assembly movable between the pair of partitions, a rear base member in opposed spaced relation to the front stop and a rear mounting rail formed separately from the rear base member and being mounted thereto, wherein the rear base member includes an elongated slot for receiving a projection of the rear mounting rail, and the rear mounting rail provides a means for interlocking the partition mounting clips of the pair of partitions such that lateral movement of the pair of partitions in the axial direction of the rear mounting rail is prohibited.

18. The retail pusher and divider system of claim 17 wherein the front and rear mounting rails, the pair partitions, the front stop, the rear base member, and the pusher assembly are made from a formed plastic, the front stop and rear base member extend laterally and generally perpendicular to the pair of partitions a length of three to twelve inches, the pair of partitions extend rearwardly from the front stop a length of six to thirty-six inches and are spaced apart three to twelve inches, and the front and rear mounting rails extend laterally and generally parallel to the front stop a length of three to twelve inches.

19. The retail pusher and divider system of claim 17 further comprising a shelf having a shelf surface that is coplanar with the base portion of the front and wherein the pusher assembly includes at least one wheel in direct rolling contact with the shelf surface.

* * * * *

UNITED STATES PATENT AND TRADEMARK OFFICE

CERTIFICATE OF CORRECTION

PATENT NO. : 8,016,128 B2
APPLICATION NO. : 12/174157
DATED : September 13, 2011
INVENTOR(S) : Stanley C. Valiulis and Patrick J. Barkdoll It is certified that error appears in the above-identified patent and that said Letters Patent is hereby corrected as shown below:

Col. 16, Claim 13,
Line 12, change “air” to “pair”

Col. 16, Claim 13,
Line 13, after “mounted”, insert --to the front--

Signed and Sealed this
Sixth Day of December, 2011

David J. Kappos

David J. Kappos
*Director of the United States Patent and Trademark Office*